US010081026B2

(12) United States Patent
Garrett et al.

(10) Patent No.: US 10,081,026 B2
(45) Date of Patent: Sep. 25, 2018

(54) SPRAYING SYSTEM AND METHODS OF USE THEREOF

(71) Applicant: University of Florida Research Foundation, Inc., Gainesville, FL (US)

(72) Inventors: Timothy James Garrett, Gainesville, FL (US); William Pratt Mounfield, III, Atlanta, GA (US)

(73) Assignee: University of Florida Research Foundation, Inc., Gainesville, FL (US)

( * ) Notice: Subject to any disclaimer, the term of this patent is extended or adjusted under 35 U.S.C. 154(b) by 0 days.

(21) Appl. No.: 15/375,799

(22) Filed: Dec. 12, 2016

(65) Prior Publication Data

US 2017/0087572 A1 Mar. 30, 2017

Related U.S. Application Data

(62) Division of application No. 13/992,400, filed as application No. PCT/US2011/062580 on Nov. 30, 2011, now Pat. No. 9,561,514.

(60) Provisional application No. 61/420,395, filed on Dec. 7, 2010.

(51) Int. Cl.

| | |
|---|---|
| ***B05B 7/04*** | (2006.01) |
| ***B05B 7/12*** | (2006.01) |
| ***B05D 1/02*** | (2006.01) |

(52) U.S. Cl.

CPC ..... *B05B 7/0416* (2013.01); *B05B 7/12* (2013.01); *B05D 1/02* (2013.01)

(58) Field of Classification Search

None

See application file for complete search history.

(56) References Cited

U.S. PATENT DOCUMENTS

| | | | | |
|---|---|---|---|---|
| 3,146,950 | A | 9/1964 | Lancaster | |
| 3,238,918 | A | 3/1966 | Radke et al. | |
| 5,388,761 | A * | 2/1995 | Langeman | B01F 15/00285 222/138 |
| 5,952,220 | A * | 9/1999 | Sene | A61K 9/0078 424/93.21 |
| 6,707,038 | B2 | 3/2004 | Ellson et al. | |
| 6,746,539 | B2 | 6/2004 | Sun et al. | |
| 6,809,315 | B2 * | 10/2004 | Ellson | G01N 33/54393 250/288 |
| 6,855,925 | B2 | 2/2005 | Ellson et al. | |
| 7,019,288 | B2 | 3/2006 | Becker | |
| 7,118,629 | B2 | 10/2006 | Davidson | |
| 7,405,395 | B2 | 7/2008 | Ellson et al. | |

(Continued)

FOREIGN PATENT DOCUMENTS

| | | | |
|---|---|---|---|
| WO | 1999043606 | A1 | 9/1999 |
| WO | 2001003848 | A1 | 1/2001 |

(Continued)

OTHER PUBLICATIONS

Automated Solvent-Free Matrix Deposition for Tissue Imaging by Mass Spectrometry, Dec. 7, 2009.

(Continued)

*Primary Examiner* — Nathan T Leong

(74) *Attorney, Agent, or Firm* — Thomas Horstemeyer, LLP

(57) ABSTRACT

Embodiments of the present disclosure provide for spraying systems, methods of disposing a layer of matrix onto a sample, and the like.

21 Claims, 6 Drawing Sheets

(56) References Cited

U.S. PATENT DOCUMENTS

| | | | | |
|---|---|---|---|---|
| 7,723,917 | B2 | 5/2010 | Shin et al. | |
| 2003/0216337 | A1 | 11/2003 | Hallahan | |
| 2005/0212837 | A1 | 9/2005 | Yoshiyuki et al. | |
| 2006/0138319 | A1* | 6/2006 | Barnes | H01J 49/0418 250/288 |
| 2006/0263529 | A1 | 11/2006 | Lustiger et al. | |
| 2007/0120280 | A1 | 5/2007 | Anchordoquy et al. | |
| 2007/0176093 | A1 | 8/2007 | Kukla et al. | |
| 2008/0128614 | A1 | 6/2008 | Nikolaev | |
| 2009/0289182 | A1 | 11/2009 | Pevsner | |
| 2009/0294695 | A1 | 12/2009 | Alquier et al. | |
| 2010/0090101 | A1 | 4/2010 | Schultz et al. | |

FOREIGN PATENT DOCUMENTS

| | | | |
|---|---|---|---|
| WO | 2003031074 | A1 | 4/2003 |
| WO | 2006037823 | A1 | 4/2006 |
| WO | 2010011771 | A2 | 1/2010 |

OTHER PUBLICATIONS

Imaging MALDI Mass Spectrometry Using an Oscillating Capillary Nebulizer Matrix Coating System and Its Application to Analysis of Lipids in Brain from a Mouse Model of Tay-Sachs/Sandhoff Disease, Mar. 4, 2008.

The International Search Report and Written Opinion dated May 16, 2012.

* cited by examiner

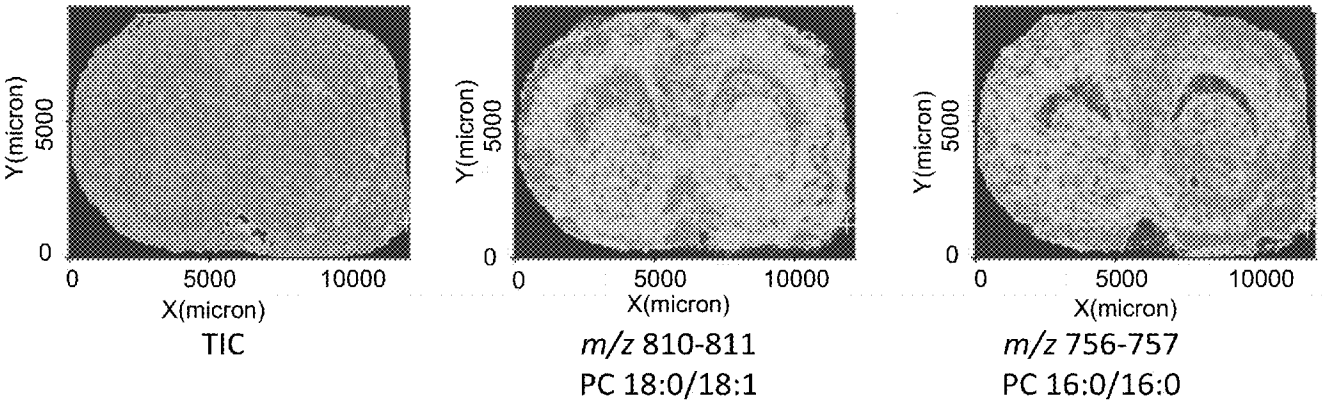
FIG. 3
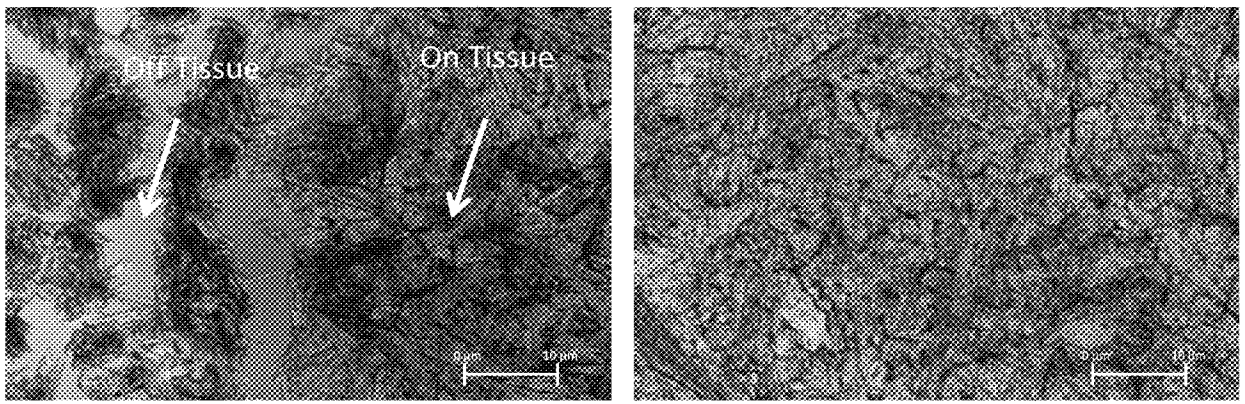

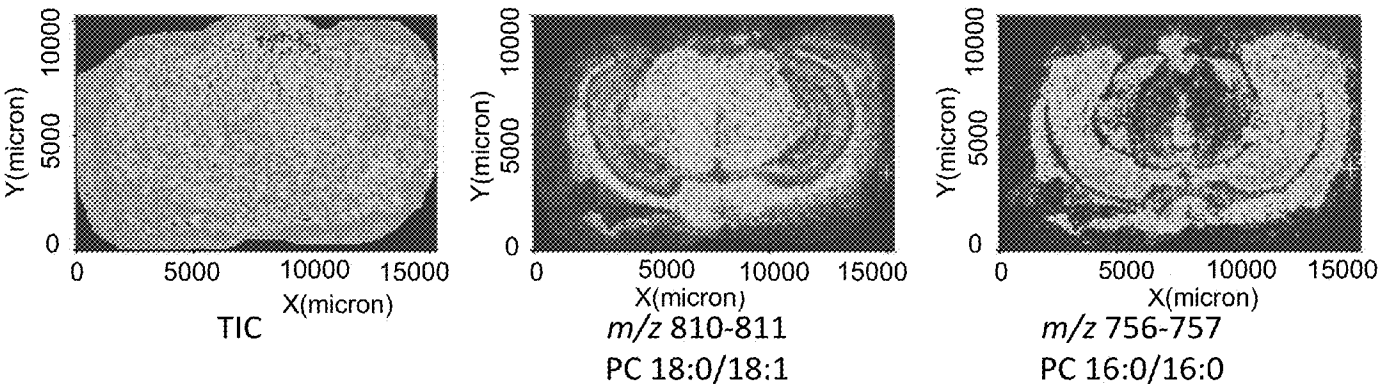
FIG. 4
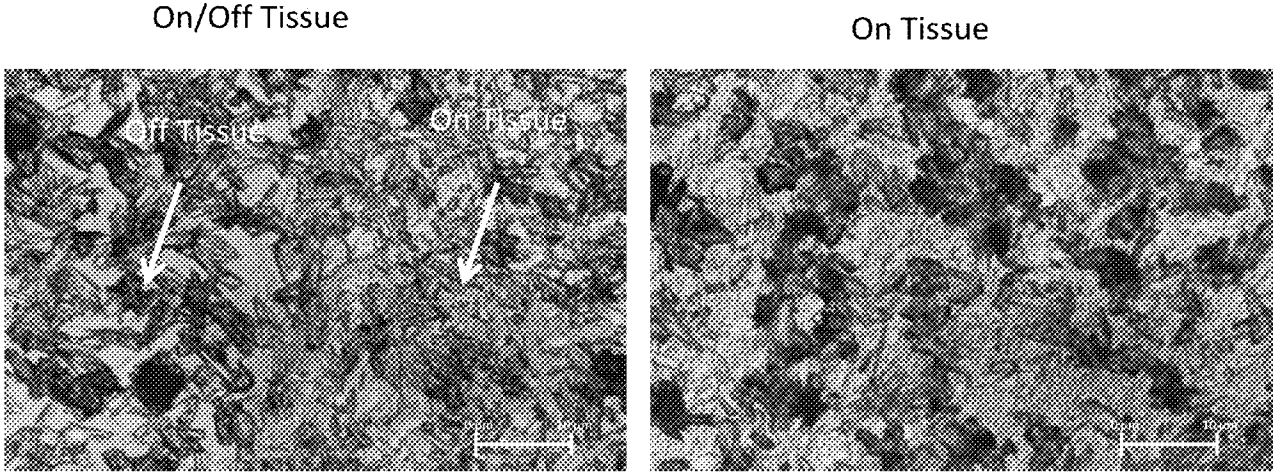

SPRAYING SYSTEM AND METHODS OF USE THEREOF

CROSS-REFERENCE TO RELATED APPLICATION

This application is a divisional application of and claims the benefit of and priority of U.S. patent Ser. No. 13/992,400 entitled "SPRAYING SYSTEM AND METHODS OF USE THEREOF," filed Jun. 7, 2013, where U.S. patent Ser. No. 13/992,400 is the 35 U.S.C. § 371 national stage of PCT application PCT/US2011/062580 filed Nov. 30, 2011, where PCT/US2011/062580 claims priority to and the benefit of U.S. Provisional Application Ser. No. 61/420,395, filed Dec. 7, 2010, both of which is are hereby incorporated by reference herein in its their entirety.

BACKGROUND

In electrospray, very small droplets can be produced, but it is difficult to set up and only works with conductive surfaces and requires use of a high voltage (>3000V). The coating process is very long because flow rates are typically <5 μL/min (30 min to 1 hr/sample). Components of the electrospray system are prone to clogging because of high concentrations of matrix employed. Also, only one sample at a time can be processed, which slows down the process. In addition, electrospray systems can only produce a very thin coating, which may be insufficient to desorb ions without causing significant ion fragmentation or not provide a high intense signal for low abundant species.

Another technique is inkjet printing, but inkjet printing is incompatible with strong solvents such as chloroform and low pH solutions. In addition, the process for coating is long (e.g., over 30 min/sample). Also, inkjet printing is prone to clogging and the lifetime of the printer is very short (<6 months).

Airbrushing is another technique that can be used to form a layer of matrix. Airbrushing is problematic because uniformity and reproducibility of the matrix layer is often difficult to control. In addition, the process for coating is long (e.g., over 30 min/sample) and only one sample at a time can be processed.

Dry coating is yet another technique, and it works by shaking matrix powder onto a sample, but reproducibility is problematic and matrix incorporation into the tissue is minimal.

Thus, there is a need to provide an alternative approach to the one noted above.

SUMMARY

Embodiments of the present disclosure provide for spraying systems, methods of disposing a layer of matrix onto a sample, and the like.

An embodiment of the spraying system, among others, includes: a liquid system for providing a liquid to a nebulizer; a gas system for providing a gas to the nebulizer, wherein the nebulizer is configured to produce a nebulized liquid; a control system for controlling the introduction of the liquid, the gas, or the liquid and gas, to the nebulizer; and a sample system, wherein the sample system includes an area for a sample to be disposed, wherein the nebulizer directs the liquid onto the area where the sample is to be disposed via the nozzle.

An embodiment of the method of disposing a layer of a matrix on a sample, among others, includes: providing at least one sample; disposing a layer of a matrix uniformly onto a portion at least one sample in about 2 to 30 seconds, wherein the layer of matrix is about 100 nm to 500 μm thick.

BRIEF DESCRIPTION OF THE DRAWINGS

Many aspects of the disclosed devices and methods can be better understood with reference to the following drawings. The components in the drawings are not necessarily to scale, emphasis instead being placed upon clearly illustrating the relevant principles. Moreover, in the drawings, like reference numerals designate corresponding parts throughout the several views.

FIG. 3 illustrates mass spectrometric images (top panels) for the total ion current (TIC) and two phosphatidylcholines (PC) at the specified m/z values from a rat brain tissue section that was coated using the inkjet printer.

FIG. 4 illustrates mass spectrometric images (top panels) for the total ion current (TIC) and two phosphatidylcholines (PC) at the specified m/z values from a rat brain tissue section that was coated using the spray system.

DETAILED DESCRIPTION

Figure 1:
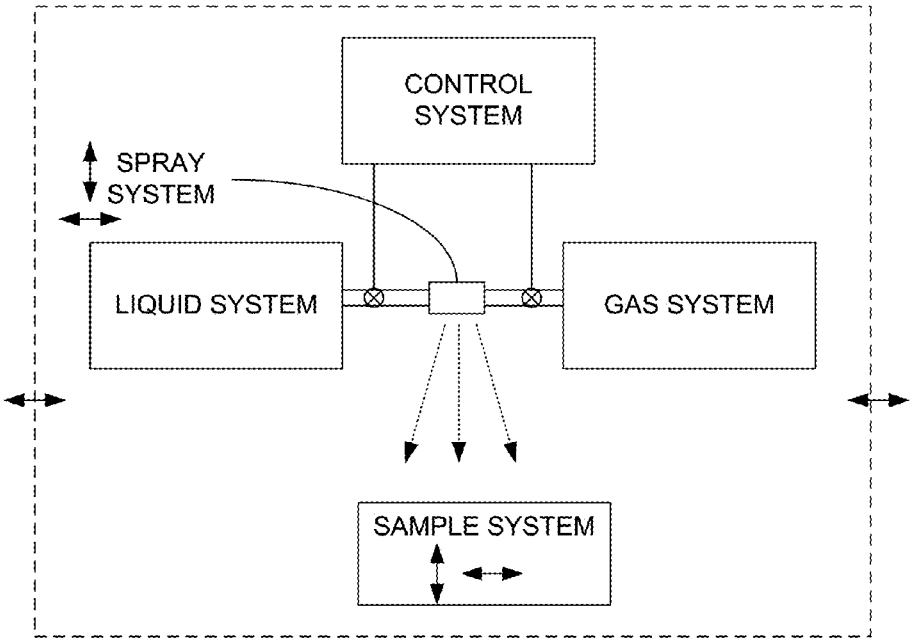
FIG. 1 illustrates an embodiment of a spraying system that can include a liquid delivery system, a gas delivery system, a nebulizer, a control system, and a sample system.

Before the present disclosure is described in greater detail, it is to be understood that this disclosure is not limited to particular embodiments described, as such may, of course, vary. It is also to be understood that the terminology used herein is for the purpose of describing particular embodiments only, and is not intended to be limiting, since the scope of the present disclosure will be limited only by the appended claims.

Where a range of values is provided, it is understood that each intervening value, to the tenth of the unit of the lower limit (unless the context clearly dictates otherwise), between the upper and lower limit of that range, and any other stated or intervening value in that stated range, is encompassed within the disclosure. The upper and lower limits of these smaller ranges may independently be included in the smaller ranges and are also encompassed within the disclosure, subject to any specifically excluded limit in the stated range. Where the stated range includes one or both of the limits, ranges excluding either or both of those included limits are also included in the disclosure.

Unless defined otherwise, all technical and scientific terms used herein have the same meaning as commonly understood by one of ordinary skill in the art to which this disclosure belongs. Although any methods and materials similar or equivalent to those described herein can also be used in the practice or testing of the present disclosure, the preferred methods and materials are now described.

All publications and patents cited in this specification are herein incorporated by reference as if each individual publication or patent were specifically and individually indicated to be incorporated by reference and are incorporated herein by reference to disclose and describe the methods and/or materials in connection with which the publications are cited. The citation of any publication is for its disclosure prior to the filing date and should not be construed as an admission that the present disclosure is not entitled to antedate such publication by virtue of prior disclosure. Further, the dates of publication provided could be different from the actual publication dates that may need to be independently confirmed.

As will be apparent to those of skill in the art upon reading this disclosure, each of the individual embodiments described and illustrated herein has discrete components and features which may be readily separated from or combined with the features of any of the other several embodiments without departing from the scope or spirit of the present disclosure. Any recited method can be carried out in the order of events recited or in any other order that is logically possible.

Embodiments of the present disclosure will employ, unless otherwise indicated, techniques of chemistry, mass spectrometry, biology, and the like, which are within the skill of the art. Such techniques are explained fully in the literature.

The following examples are put forth so as to provide those of ordinary skill in the art with a complete disclosure and description of how to perform the methods and use the compositions and compounds disclosed and claimed herein. Efforts have been made to ensure accuracy with respect to numbers (e.g., amounts, temperature, etc.), but some errors and deviations should be accounted for. Unless indicated otherwise, parts are parts by weight, temperature is in ° C., and pressure is at or near atmospheric. Standard temperature and pressure are defined as 20° C. and 1 atmosphere.

Before the embodiments of the present disclosure are described in detail, it is to be understood that, unless otherwise indicated, the present disclosure is not limited to particular materials, reagents, reaction materials, manufacturing processes, or the like, as such can vary. It is also to be understood that the terminology used herein is for purposes of describing particular embodiments only, and is not intended to be limiting. It is also possible in the present disclosure that steps can be executed in different sequence where this is logically possible.

It must be noted that, as used in the specification and the appended claims, the singular forms "a," "an," and "the" include plural referents unless the context clearly dictates otherwise. Thus, for example, reference to "a support" includes a plurality of supports. In this specification and in the claims that follow, reference will be made to a number of terms that shall be defined to have the following meanings unless a contrary intention is apparent.

DISCUSSION

In accordance with the purpose(s) of the present disclosure, as embodied and broadly described herein, embodiments of the present disclosure, in one aspect, relate to spraying systems and methods of disposing a layer of matrix onto a sample, and the like. Embodiments of the present disclosure are useful in mass spectrometry, in particular in imaging mass spectrometry, that uses matrix-assisted laser desorption/ionization (MALDI). Specifically, embodiments of the present disclosure can be used to prepare samples for analysis by imaging mass spectrometry.

Embodiments of the present disclosure are advantageous over other techniques. In short, embodiments of the present disclosure can be used to form a uniform (e.g., about the same thickness across a desired portion of the tissue or the entire tissue and the same crystal size range) matrix layer on a portion of a sample or on multiple samples (e.g., spray onto small to large areas (e.g., up to and over a 6×6 inch area)) in a short period of time (e.g., in less than 20 seconds), and is compatible with many types of solvents (e.g., acids, bases, and water) or mixtures of solvents.

An exemplary embodiment of the spraying system can include a liquid delivery system, a gas delivery system, a nebulizer, a control system, and a sample system. An exemplary embodiment is illustrated in FIG. 1. The liquid delivery system can provide the liquid that is introduced to the nebulizer. The gas delivery system can provide the gas that is introduced to the nebulizer. The control system can control the type, amount, flow rate, and the like, of the liquid and/or gas to the nebulizer. In an exemplary embodiment, the control system can be electronic and/or manual. The nebulized liquid is directed onto a sample disposed on the sample system. In an exemplary embodiment, the sample system can be used to adjust the placement in the x-, y-, and/or z-direction of the sample relative to the nebulizer. In addition, the sample system can introduce samples to the spraying system (e.g., automated introduction of sample(s) to the spraying system).

In an exemplary embodiment, the liquid delivery system and/or the gas delivery system can be in communication with the nebulizer using tubing (e.g., stainless steel), flow controllers, control valves, and the like. The control system can be in communication with the various components to control the introduction of the liquid and/or gas with the nebulizer. In an embodiment, the stainless steel tubing can be used to connect the liquid delivery system and the gas delivery system with the nebulizer.

In an exemplary embodiment, the liquid delivery system can introduce one or more types of liquids and/or can introduce a mixture of liquids with or without use of the control system. In an exemplary embodiment, the liquid delivery system can include mixing chambers to mix liquids. The liquid delivery system can be selected from: a gravity liquid delivery system, a siphon liquid delivery system, a pressurized liquid delivery system, or a combination thereof. In an exemplary embodiment, the liquid delivery system can be heated or cooled.

In an exemplary embodiment, the gas delivery system can introduce one or more types of gases and/or can introduce a mixture of gases with or without use of the control system. The gas can be stored in typical gas cylinders, or intermediate chambers for mixing, and can be controlled using typical gas flow controllers, meters, and valves. In an exemplary embodiment, the gas delivery system can be heated or cooled.

In an exemplary embodiment, the function of the control system is to regulate the flow of the gas and/or liquid so that the liquid is nebulized and forms the desired matrix layer on the sample. As mentioned above, the control system can control the type, amount, flow, and the like, of the liquid and/or gas to the nebulizer. The control system can include computer controlled portions and/or manually controlled portions. In an embodiment, the control system includes a controller (e.g., programmable logic controller), which may include software to activate (e.g., open and close) valves, flow controllers, and the like. In an embodiment, the controller can include simple switches to activate valves, flow controllers, and the like. The control system can be as simple as a set of manual flow control valves or can include a wide range of computer controlled flow control valves for the liquid and/or the gas, or a combination of both.

In an exemplary embodiment, the nebulizer functions to nebulize the liquid and direct the nebulized liquid toward the sample. In an exemplary embodiment, the nebulizer can be selected or adjusted so that the nebulized liquid contacts a small or large area of a sample or multiple samples. In an exemplary embodiment, the structure of the nebulizer can function to nebulize the liquid internally (mix the gas and fluid inside the nebulizer) or externally (mix the gas and liquid outside of the nebulizer).

Figure 2A:
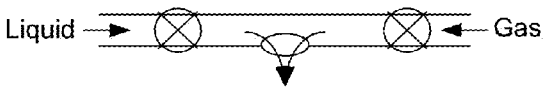
FIGS. 2A, 2B, and 2C illustrate an embodiment of a configuration of the nebulizer.
Figure 2B:
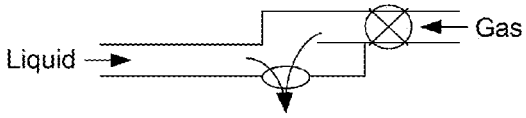
Figure 2C:
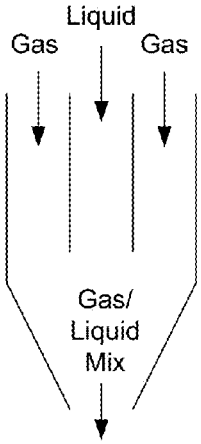

In an embodiment, the nebulizer can be configured like those shown in FIG. 2A, 2B, or 2C. FIG. 2A illustrates a nebulizer that includes a valve to control the liquid and gas flow prior to mixing and flowing out of the exit of the nebulizer, where the flow of the gas and liquid can be perpendicular the flow of the mixture out of the exit. FIG. 2B illustrates a nebulizer where the liquid flow path is offset relative to the gas flow path and a valve to control the gas flow prior to mixing with the liquid. In an embodiment, the offset path of the gas flow may direct the gas to flow directly out of the exit of the nebulizer, while the liquid flow is perpendicular the exit. FIG. 2C illustrates a nebulizer where the gas and liquid both flow in a path parallel the exit of the nebulizer. The gas and liquid can mix inside the nebulizer tip just prior to exiting the nebulizer. In an alternative embodiment, the gas and liquid can mix after exiting the nebulizer tip.

In an embodiment, the spraying system can include one or more nebulizers. The nebulizer(s) can be positioned in a horizontal, vertical, and/or inverted position relative to the sample. In an exemplary embodiment, the nebulizer can be positioned about 0.1 to 60 inches or about 10 to 48 inches, from the sample. The distance between the nebulizer and the sample can be controlled by adjustment of the nebulizer and/or the sample system. In an exemplary embodiment, the nebulizer can be heated or cooled.

In an exemplary embodiment, the sample system can function to introduce one or more samples to the spraying chamber and also can function to place the sample in a certain position relative to the nebulizer. The sample system can position the sample in the x-, y-, and/or z-directions, relative to the nebulizer. The sample system can include an area for the sample(s) to be disposed on. In an embodiment, the sample system can include one or more automated systems for moving or positioning the sample(s). For example, the sample system can include an arm (e.g., a robotic arm) for moving the sample. In another example, the sample system can include a conveyer system to move the sample. In an exemplary embodiment, the sample system can be heated or cooled.

In an embodiment, the liquid delivery system, the gas delivery system, the nebulizer, the control system, and/or the sample system, or portions of one or more of these are included in a chamber. In an embodiment, the nebulizer and the sample are included in a chamber. The chamber can be heated or cooled, filled with heated or cooled gas, and/or can be pressurized or under a vacuum (e.g., using a vacuum system). The dimensions of the chamber can be adjusted based on the design or desired configuration.

In an exemplary embodiment, the sampling system can operate by positioning a sample on the area of the sample system for the sample. One or more liquids can be nebulized using one or more gases. In an exemplary embodiment, the nebulized liquid can be directed onto a portion of at least one sample or onto one or more samples for a period of time to form a layer of matrix. The layer of matrix can be formed on an area of millimeters to inches, for example, up to 6 inches or more. The layer of matrix is uniformly formed on a portion of the sample or the entire sample and can have a thickness of about 100 nm to 500 μm. The nebulized liquid can be directed onto the sample for about 2 to 30 seconds, in less than 20 seconds, or in less than 10 seconds. In another embodiment, it may be desired to direct the nebulized liquid onto the sample for a period of minutes. The time of the spraying can depend at least upon the desired thickness of the layer of matrix, the composition of the matrix, the size of the nebulizer, the solvent composition, the gas flow rate, and combinations thereof.

In an embodiment, the liquid can be selected from chloroform, methanol, ethanol, isopropanol, water, t-butylmethyl ether, an acid (e.g., formic acid, acetic acid, trifluoroacetic acid, and the like), or a base (e.g., sodium hydroxide, potassium hydroxide, ammonium hydroxide, and the like), and a combination thereof. In an embodiment, the acid is not hydrochloric acid. In an embodiment, the gas can be selected from nitrogen, argon (or other noble gases), oxygen, helium, water vapor, tetrafluoroethane, and a combination thereof. In an embodiment, the matrix can be selected from 2,5-dihydroxybenzoic acid, alpha-cyano-4-hydroxycinnamic acid, sinapinic acid, trihydroxyacetophenone, dihydroxyacetophenone, p-Nitroaniline, 1,5-diaminonapthalene, and a combination thereof, and another matrix employed for MALDI sample preparation.

The sample to which the matrix layer is applied can be a tissue(s) (e.g., organ tissue, brain tissue, etc.) disposed on a surface of a structure, such as a glass slide. In another embodiment, a layer of material can be disposed onto the surface prior to placing the tissue on the structure. The layer of material can be applied using the spraying system described herein or using another system. In an exemplary embodiment, the layer of material could include one or more chemicals that can be used as a standard (e.g., internal standard to measure the ratio of the chemical and the same chemical that may be in portions of the tissue and/or a standard to measure the effectiveness of the laser desorption).

EXAMPLES

Now having described the embodiments of the disclosure, in general, the examples describe some additional embodiments. While embodiments of the present disclosure are described in connection with the example and the corresponding text and figures, there is no intent to limit embodiments of the disclosure to these descriptions. On the contrary, the intent is to cover all alternatives, modifications, and equivalents included within the spirit and scope of embodiments of the present disclosure.

Example 1

FIG. 3 illustrates mass spectrometric images (top panels) for the total ion current (TIC) and two phosphatidylcholines (PC) at the specified m/z values from a rat brain tissue section that was coated using the inkjet printer. The conditions for the inkjet printing of the matrix were 15 "prints"

using 2,5-dihydroxybenzoic acid (40 mg/mL) dissolved in 50/50 methanol/water. The coating process took over 30 min. The crystal sizes produced are shown in the bottom panels for an area off of the tissue (blank glass slides) and on the tissue. The scale bar is 10 μm.
(Significance-High)

FIG. 4 illustrates mass spectrometric images (top panels) for the total ion current (TIC) and two phosphatidylcholines (PC) at the specified m/z values from a rat brain tissue section that was coated using the spray system of the present disclosure. The conditions for the spray system of the matrix were 2 coats using 2,5-dihydroxybenzoic acid (40 mg/mL) dissolved in 50/50 chloroform/methanol. The coating process took approximately 15 sec. The crystal sizes produced are shown in the bottom panels for an area off of the tissue (blank glass slides) and on the tissue. The scale bar is 10 μm. The crystal density is very uniform and the crystal sizes are less than 10 μm in length. (Significance-High)

Figure 5:
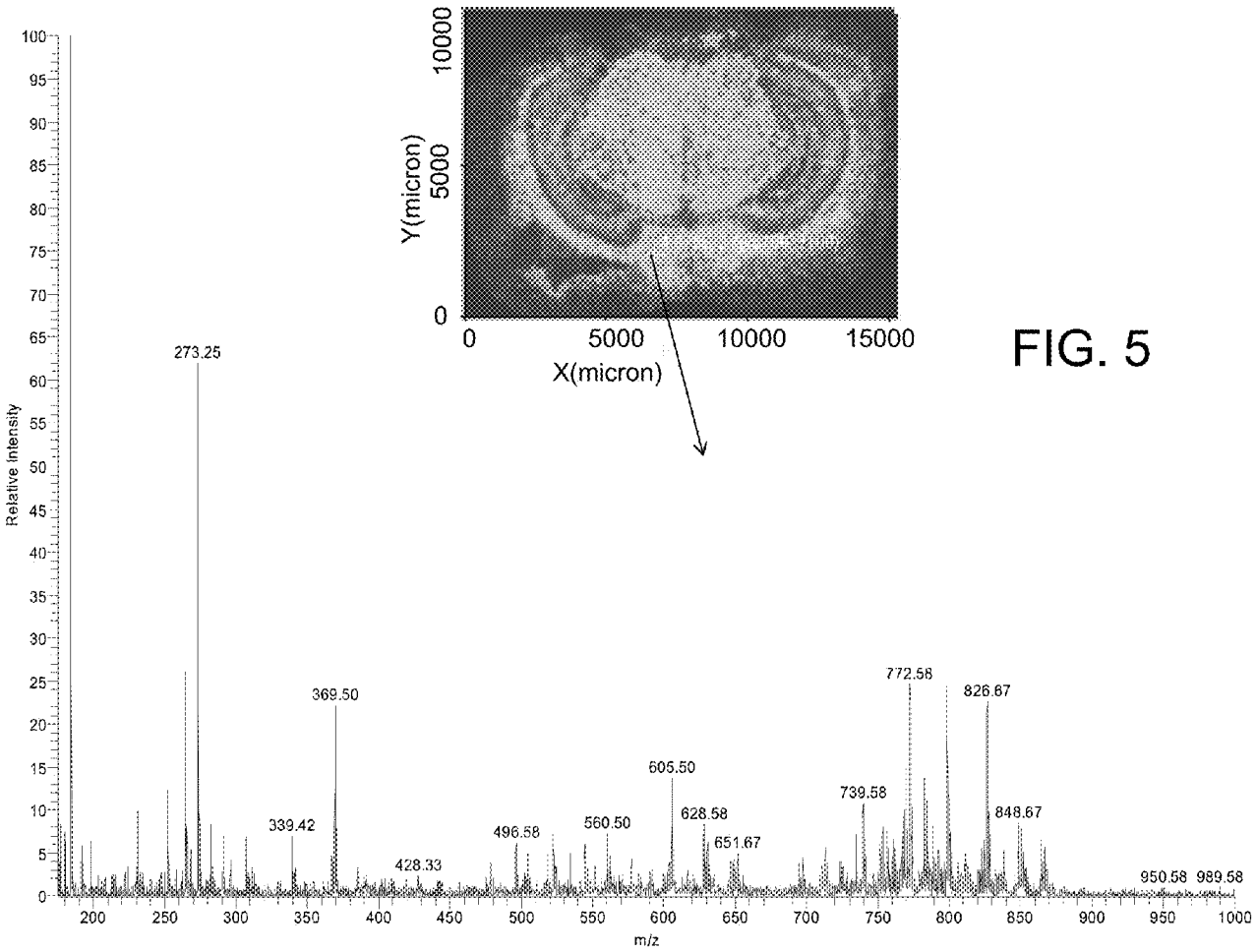
FIG. 5 illustrates a MALDI mass spectrum from the area indicated with the arrow (white matter of the brain, corpus collosum) and the MS image for m/z 810 (PC 18:0/18:1) using the spray chamber for matrix deposition (2 coats, 15 s total time).

FIG. 5 illustrates a MALDI mass spectrum from the area indicated with the arrow (white matter of the brain, corpus collosum) and the MS image for m/z 810 (PC 18:0/18:1) using the spray chamber for matrix deposition (2 coats, 15 s total time). The matrix was 2,5-dihydroxybenzoic acid in 50/50 methanol/chloroform. The mass spectrum shows a high abundance of lipids (m/z 700-900 region) as expected.

Figure 6:
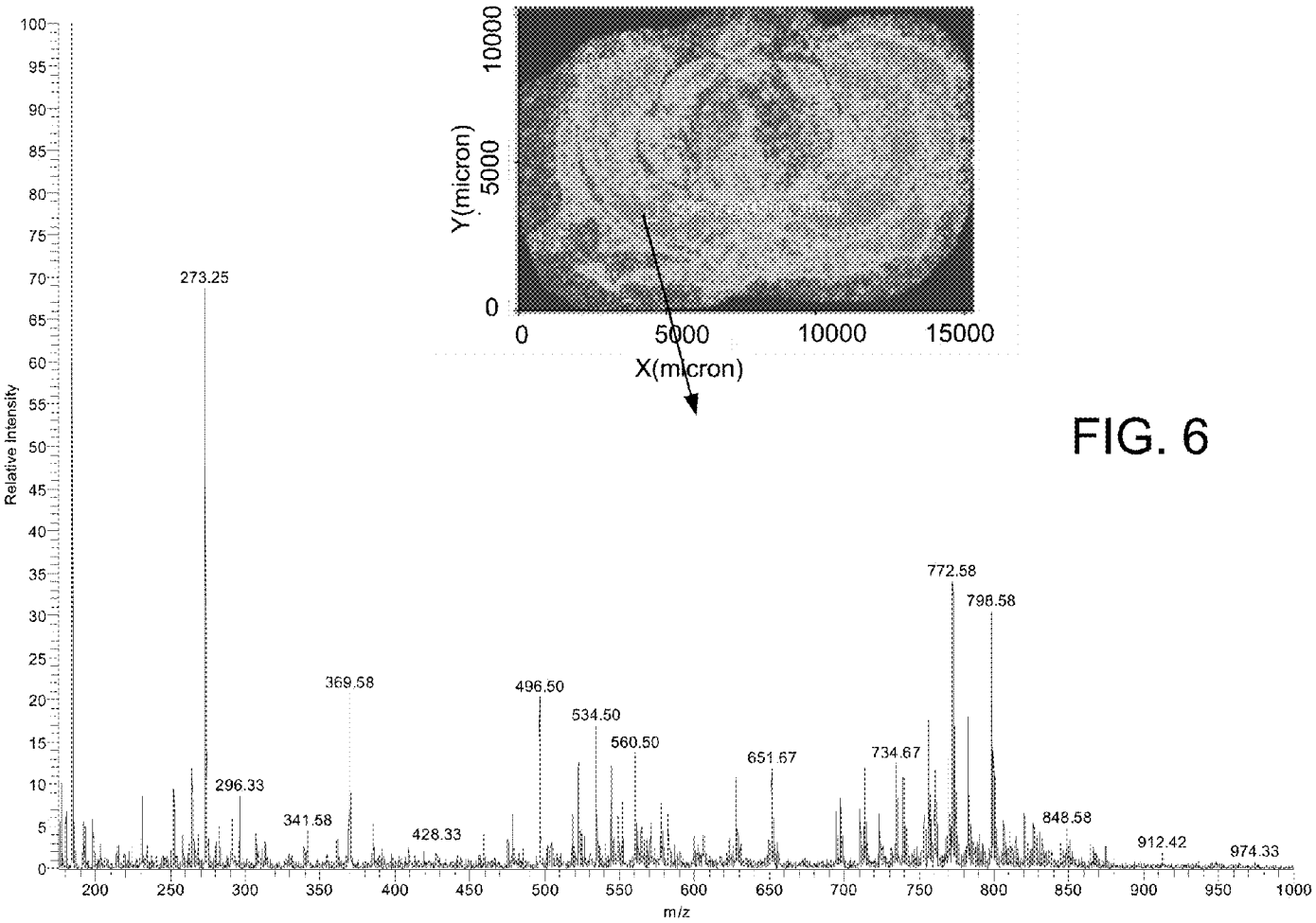
FIG. 6 illustrates a MALDI mass spectrum from the area indicated with the arrow and the MS image for m/z 756 (PC 16:0/16:0) using the spray chamber for matrix deposition (2 coats, 15 s total time).

FIG. 6 illustrates a MALDI mass spectrum from the area indicated with the arrow and the MS image for m/z 756 (PC 16:0/16:0) using the spray chamber for matrix deposition (2 coats, 15 s total time). The matrix was 2,5-dihydroxybenzoic acid in 50/50 methanol/chloroform. The mass spectrum shows that the ion population is changing when moving to a different area of the tissue, which is another indicator that analyte migration is not occurring for the ions studied.

Figure 7:
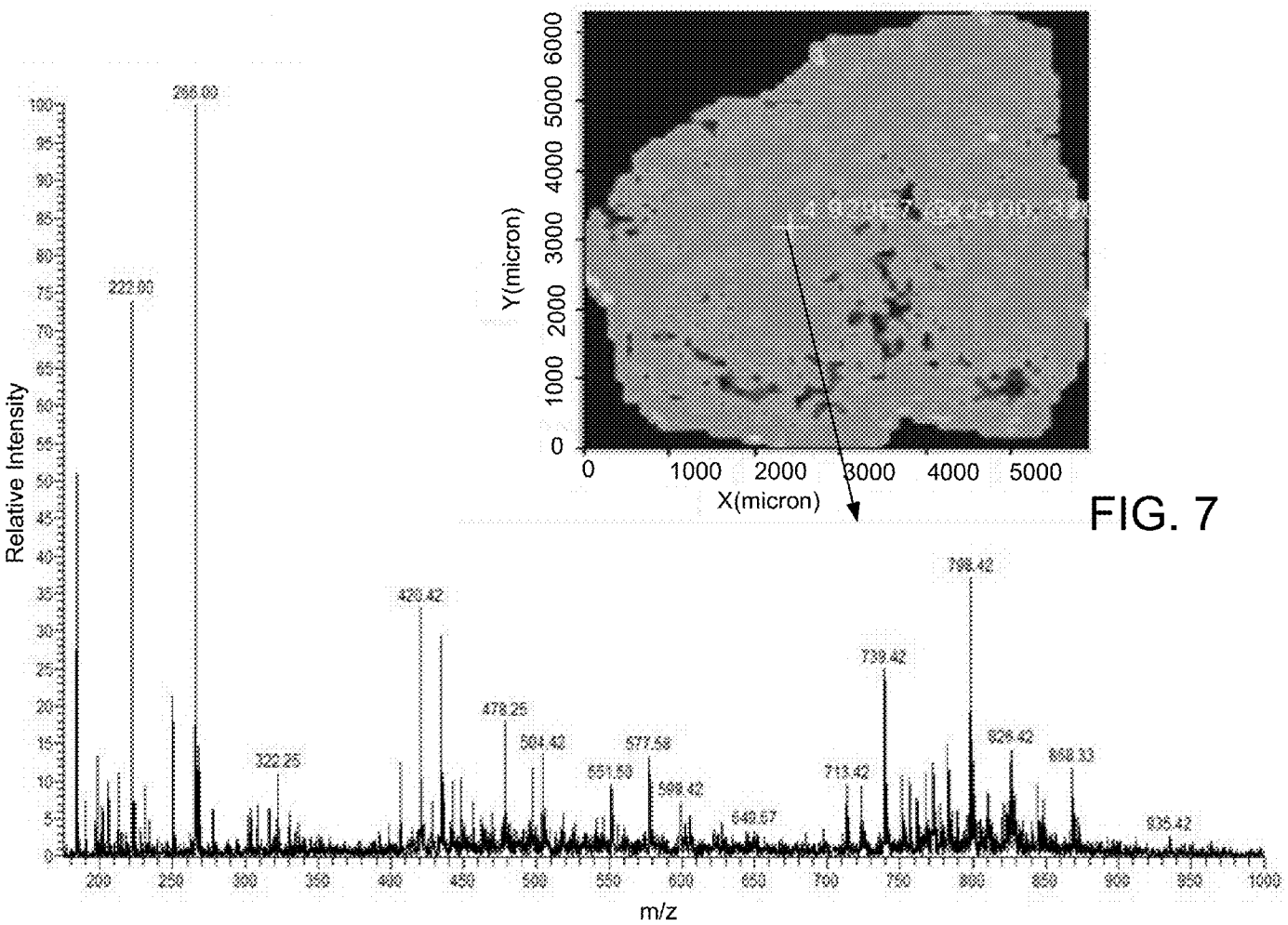
FIG. 7 illustrates a MALDI mass spectrum from the area indicated with the arrow and the MS image for the total ion current (TIC) using the spray chamber for matrix deposition. Parameters for coating α-cyano-4-hydroxycinnamic acid: 3×7.5 s coats, 24" from nozzle, 10 mg/mL 50:50 MeOH: $CHCl_3$.

FIG. 7 illustrates a MALDI mass spectrum from the area indicated with the arrow and the MS image for the TIC using the spray chamber for matrix deposition. Parameters for coating α-cyano-4-hydroxycinnamic acid: 3×7.5 s coats, 24" from nozzle, 10 mg/mL 50:50 MeOH:$CHCl_3$.

Coating with alpha-cyano produced interesting results. The coatings were observed to have a 'wetter' coating, but still dried in less than 1 s. Visually the coating on a brain sample was lighter than a coating with DHB, however, when processed, more signal was obtained from the sample coated with alpha-cyano than that with DHB. Although not intending to be bound by theory, we suspect that the 'wetter' coating allowed the matrix to permeate the tissue sample better than the dryer coating with DHB.

We also observed the effect of humidity on coating. With humidity percentage of 65%, the amount of chloroform in the solutions needed to be increased to allow the matrix solution to dry more rapidly. However, even with manipulation of parameters, obtaining an effective coating was difficult at this high humidity. With a humidity percentage of 45%, the most effective coating was obtained, and we found it much easier to reach this coating with manipulation of parameters than at the higher humidity. Due to the influence of humidity on the quality of the coats, we see that employing a humidity controlled chamber is necessary for effective coating.

It should be noted that ratios, concentrations, amounts, and other numerical data may be expressed herein in a range format. It is to be understood that such a range format is used for convenience and brevity, and thus, should be interpreted in a flexible manner to include not only the numerical values explicitly recited as the limits of the range, but also to include all the individual numerical values or sub-ranges encompassed within that range as if each numerical value and sub-range is explicitly recited. To illustrate, a concentration range of "about 0.1% to about 5%" should be interpreted to include not only the explicitly recited concentration of about 0.1 wt % to about 5 wt %, but also include individual concentrations (e.g., 1%, 2%, 3%, and 4%) and the sub-ranges (e.g., 0.5%, 1.1%, 2.2%, 3.3%, and 4.4%) within the indicated range. In an embodiment, the term "about" can include traditional rounding according to significant figures of the numerical value. In addition, the phrase "about 'x' to 'y'" includes "about 'x' to about 'y'".

It should be emphasized that the above-described embodiments of the present disclosure are merely possible examples of implementations, and are merely set forth for a clear understanding of the principles of this disclosure. Many variations and modifications may be made to the above-described embodiment(s) of the disclosure without departing substantially from the spirit and principles of the disclosure. All such modifications and variations are intended to be included herein within the scope of this disclosure and protected by the following claims.

Therefore the following is claimed:

1. A method of disposing a layer of a matrix on a sample, comprising:
- providing at least one sample;
- providing a spraying system comprising:
  - a liquid system for providing a liquid to a nebulizer;
  - a gas system for providing a gas to the nebulizer, wherein the nebulizer is configured to produce a nebulized liquid;
  - a control system for controlling the introduction of the liquid, the gas, or the liquid and gas, to the nebulizer; and
  - a sample system, wherein the sample system includes an area for the at least one sample to be disposed,
  - wherein the nebulizer directs the liquid onto the area where the sample is to be disposed via a nozzle; and
- disposing a layer of a matrix uniformly onto a portion of the at least one sample in about 2 to 30 seconds, wherein the layer of matrix is about 100 nm to 500 μm thick.

2. The method of claim 1, wherein a sample is about 10 to 20 μm thick.

3. The method of claim 1, wherein the portion of a sample includes the entire sample.

4. The method of claim 1, wherein disposing is performed in less than 20 seconds.

5. The method of claim 1, further comprising repeating the disposing step one or more times to produce the layer of matrix.

6. The method of claim 1, wherein disposing includes nebulizing a liquid that includes the matrix and wherein the nebulized liquid is directed towards the at least one sample.

7. The method of claim 6, wherein the liquid includes a solvent, wherein the solvent is selected from the group consisting of: chloroform, methanol, ethanol, isopropanol, water, t-butyl-methyl ether, an acid except hydrochloric acid, a base, and a combination thereof.

8. The method of claim 6, wherein the matrix is selected from the group consisting of: 2,5-dihydroxybenzoic acid, alpha-cyano-4-hydroxycinnamic acid, sinipinic acid, trihydroxyacetophenone, dihydroxyacetophenone, and a combination thereof.

9. The method of claim 6, wherein nebulization includes a gas, wherein the gas is selected from the group consisting of: a noble gas, oxygen, helium, water vapor, and a combination thereof.

10. A method of disposing a layer of a matrix on a sample, comprising:

providing at least one sample;

providing a spraying system comprising:

a liquid system for providing a single liquid to a nebulizer, wherein the liquid system includes a liquid delivery system selected from the group consisting of: a gravity liquid delivery system and a siphon liquid delivery system;

a gas system for providing a gas to the nebulizer, wherein the nebulizer is configured to produce a nebulized liquid from the liquid from the liquid system;

a control system for controlling introduction of the liquid, the gas, or the liquid and gas, to the nebulizer; and a sample system, wherein the sample system includes an area for the at least one sample to be disposed;

wherein the nebulizer directs the nebulized liquid onto the area where the sample is to be disposed via a nozzle of the nebulizer; and wherein the nebulizer and the area where the at least one sample is to be disposed are disposed in a chamber; and disposing a layer of a matrix uniformly onto a portion of the at least one sample in about 2 to 30 seconds, wherein the layer of matrix is about 100 nm to 500 μm thick.

11. The method of claim 10, wherein the nebulizer mixes the gas and liquid within the nebulizer.

12. The method of claim 10, wherein the control system is selected from a manual system, an automated system, or a combination thereof.

13. The method of claim 10, wherein the nebulizer is positioned above a horizontal, vertical, or inverted, position relative to the area where the sample is to be disposed.

14. The method of claim 10, wherein the chamber is heated and the nebulizer is heated.

15. The method of claim 10, wherein the nebulizer is about 0.01 to 60 inches from the area where the sample is to be disposed.

16. The method of claim 10, wherein the liquid system is adapted to heat the liquid.

17. The method of claim 10, wherein the gas system is adapted to heat the gas.

18. The method of claim 10, wherein sample system is adapted to move up and down along an y-axis and from side to side along an x-axis and a z-axis.

19. The method of claim 10, wherein the sample system includes an automated platform to position samples in sequence in the area where the sample is to be disposed.

20. The method of claim 10, wherein the chamber is a humidity controlled chamber.

21. The method of claim 10, wherein the liquid system is adapted to cool the liquid.

* * * * *